US006619392B2

(12) United States Patent
Marangoni et al.

(10) Patent No.: US 6,619,392 B2
(45) Date of Patent: Sep. 16, 2003

(54) BLAST JOINT ASSEMBLY

(75) Inventors: Marco Marangoni, Masate Mi (IT); Marcello Benedetti, Mozzo Bg (IT); Emilio Benedetti, Treviolo Bg (IT)

(73) Assignee: Fast S.r.l., Dalmine (IT)

( * ) Notice: Subject to any disclaimer, the term of this patent is extended or adjusted under 35 U.S.C. 154(b) by 0 days.

(21) Appl. No.: 09/816,315

(22) Filed: Mar. 26, 2001

(65) Prior Publication Data

US 2002/0134549 A1 Sep. 26, 2002

(30) Foreign Application Priority Data

Mar. 20, 2001 (EP) ..... 01830189

(51) Int. Cl.[7] ..... E21B 17/10; F16L 55/00

(52) U.S. Cl. ..... 166/243; 166/902; 166/65.1; 285/45; 285/92

(58) Field of Search ..... 166/902, 243, 166/242.4, 242.6, 241.7, 65.1; 138/100, 177, 159, 156; 285/45, 92

(56) References Cited

U.S. PATENT DOCUMENTS 3,171,889 A * 3/1965 McCarthy ..... 174/136
4,028,796 A 6/1977 Bergstrom
4,202,087 A * 5/1980 Wilderman ..... 166/243
4,337,969 A * 7/1982 Escaron et al. ..... 166/65.1
4,381,821 A 5/1983 Greene, Jr.
4,614,120 A * 9/1986 Fradin et al. ..... 116/212
4,635,464 A * 1/1987 McGuire et al. ..... 72/466
4,676,529 A * 6/1987 McDonald ..... 285/334
4,889,185 A * 12/1989 Uherek et al. ..... 138/147
4,902,047 A * 2/1990 Marietta et al. ..... 285/334
4,962,579 A * 10/1990 Moyer et al. ..... 285/334
5,110,158 A * 5/1992 Sabo et al. ..... 285/137.11
5,275,441 A * 1/1994 Claycomb ..... 166/243
5,334,268 A * 8/1994 Hermanson et al. ..... 148/530
5,369,579 A 11/1994 Anderson
5,394,823 A * 3/1995 Lenze ..... 166/105
5,549,333 A * 8/1996 Uherek et al. ..... 166/243
5,796,034 A * 8/1998 Pate ..... 138/127
5,973,270 A * 10/1999 Keller ..... 174/136
6,209,632 B1 * 4/2001 Holbert et al. ..... 166/242.6

* cited by examiner

*Primary Examiner*—David Bagnell
*Assistant Examiner*—T. S Bomar
(74) *Attorney, Agent, or Firm*—Nixon & Vanderhye P.C.

(57) ABSTRACT

Blast joint assemblies are used for integral prevention of erosion of a production string crossing a production zone and simultaneous protection of hydraulic, electric and/or optical lines which need to cross same zones to operate and retrieve data from downhole operated tools. Each assembly is composed by one or more modular joint bodies having each at least one longitudinal slot on its outer surface; protecting covers shielding the longitudinal slots to house control lines housed in each of the longitudinal slots, with the protecting covers being properly retained on the related tubular joint body. The tubular joint bodies are precision machined to be connected by male and female threads granting an exact alignment of all slots in the blast joint(s) and allowing any combination of lengths for coping with any required assembly.

10 Claims, 2 Drawing Sheets

BLAST JOINT ASSEMBLY

BACKGROUND OF THE INVENTION

The present invention relates to a blast joint suitable for service in production zones where the joint is subjected to high speed particle impingement.

Blast joints are used in the production zones of oil and gas wells in order to protect the production tubing string against the abrasive environments, such as e.g. high speed particle (sand grains) impingement.

Particularly, in formations producing high pressure gas, the flow into the well bore is at high velocities. The fluid stream containing abrasive materials impinges on the production tubing causing its abrasion and erosion. In these situations, it is desirable to protect the production tubing. Many different efforts have been made to solve the problem of the erosion due to producing fluids.

The blast joints known in the prior art include a series of elements, such as protection rings made of abrasive resistant materials, mounted about a tubular member U.S. Pat. Nos. 4,381,821; 4,028,796). The elements are supported on the tubular member and compressed together by different kinds of support means (e.g., cover rings in U.S. Pat. No. 4,889, 185) thereby forming a coupling shield around the tubular member.

U.S. Pat. No. 5,549,333 discloses in addition the use of elastomer spacer rings which held carbide protection rings to maintain them in end-to-end contact to fully protect the tubing string against erosion from the incoming fluids and particles; as well as permit movement of the carbide protection rings during assembly installation and operation of the blast joint.

The abrasive resistant material used in the art is comprised of cemented tungsten carbide.

U.S. Pat. No. 5,369,579 discloses an electric blast control system incorporating an elongated instrument body including a plurality of electronic control modules which sense programmed well conditions such as fluid temperature and hydrostatic pressure, motion of the instrument body as it traverses the well bore. The electronic control modules provide electric logic pulses to a central processing unit, which define safe and unsafe parameters for downhole blasting operations.

With the evolution of new completion technologies, such as the use of hydraulic and electric power within the blast joints, the design of conventional blast joints is no more sufficient. In fact, the tools used recently downhole (e.g. ICVs: Interval Control Valves), require to be remotely operated via hydraulic and/or electric lines and this requires the integrity of the mentioned control lines and the production tubing for their expected life time cycle.

SUMMARY OF THE INVENTION

It is therefore an object of the present invention to provide a blast joint assembly which can be used for integral prevention of erosion of a production string crossing a production zone and simultaneous protection of hydraulic, electric and/or optical lines which need to cross same zones to operate and retrieve data from downhole operated tools.

Another object of the present invention is to provide a blast joint assembly which can be assembled and aligned in a simple way from modular starting joint elements in a short period of time and which withstands the highly corrosive and/or high temperature environments of the well bores.

A further object of the present invention is to provide a blast joint assembly which allows to cross perforated levels granting a reliable transmission of hydraulic and/or electric power between remote operated tools and controls placed on opposite sites of a perforation set.

These objects have been obtained by a blast joint assembly according to the present invention comprising at least one tubular joint body having at least one longitudinal slot on its outer surface, at least one series of protecting cover (shielding the longitudinal slot(s) to protect the control lines housed in the slot(s)) and structure for retaining the protecting cover on the joint body.

Any desired length of blast joint assembly can be assembled from modular tubular joint bodies according to the present invention by making up the ends of two or more tubular joint bodies, which are suitably threaded so to obtain a metal to metal high precision and very tough shoulder connection.

BRIEF DESCRIPTION OF THE DRAWING

The appended drawings are provided in order to illustrate one of the preferred embodiments of this invention. These drawings should not be considered limitations of the scope of this invention for it may encompass other effective embodiments.

DETAILED DESCRIPTION OF PREFERRED EMBODIMENTS

Figures 1A, 1B:
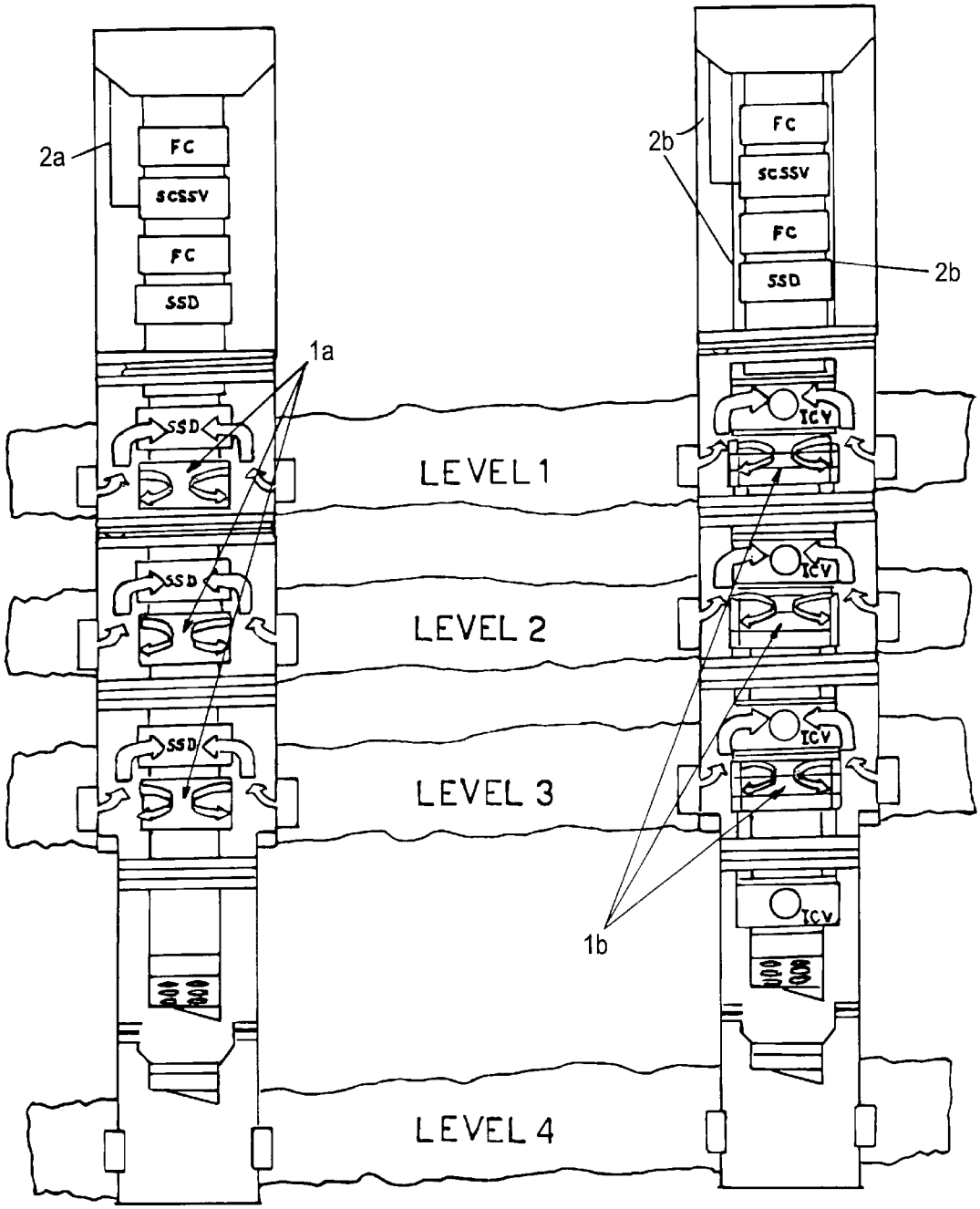
FIG.1a (PRIOR ART)
FIGS. 1*a* and 1*b* are cross-sectional diagrammatic views of a blast joint assembly according to the prior art (1*a*) and respectively according to the preferred embodiment of the present invention (1*b*).

FIG. 1*a* shows blast joints 1*a* according to the prior art, operating in front of individual producing levels (levels 1, 2 and 3) and having extra thickness and surface hardness so to withstand the perpendicular impact energy of the flow coming out of perforations. As it can be seen from FIG. 1*a,* being the blast joints solid there is no possibility to protect any possible control or instrument line crossing the perforating intervals, so that these lines 2*a* must be limited to control the very upper devices in the downhole.

FIG. 1*b* illustrates blast joint assemblies 1*b* according to the present invention always operating in a well and wherein the control lines 2*b,* normally attached externally to the production pipe, are protected in correspondence to the blast joints.

Figure 3:
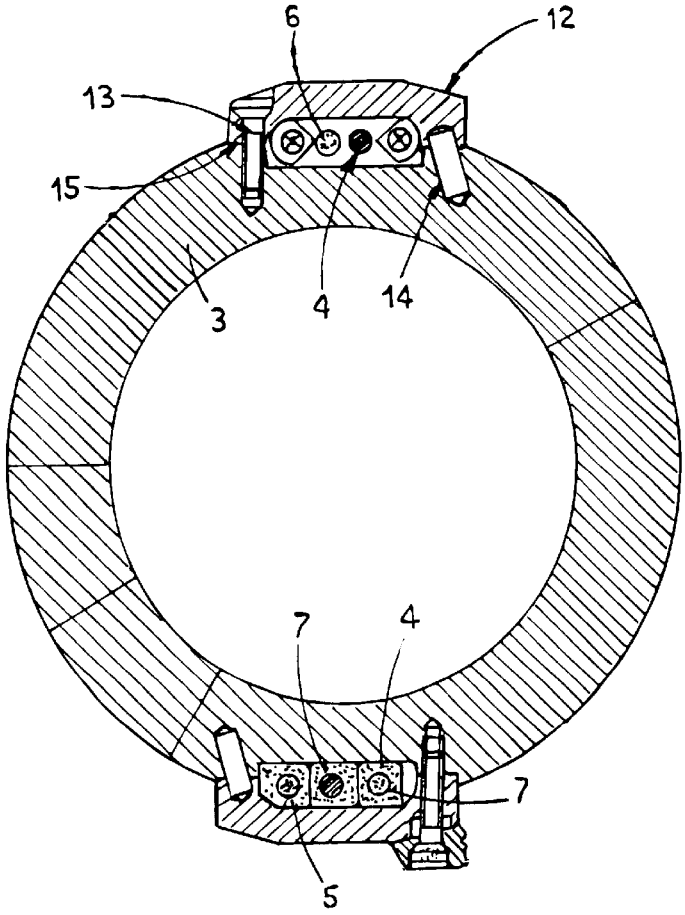
FIG. 3 shows a cross section of a blast joint body according to FIG. 2.
Figure 2:
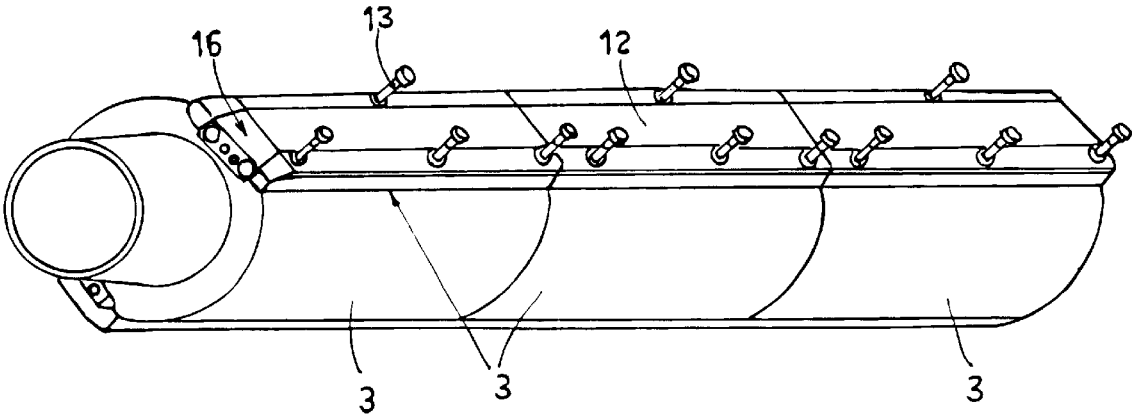
FIG. 2 is a schematic perspective view of the proposed embodiment of the blast joint assembly according to the present invention.

Each blast joint assembly 1*b* according to the present invention, as shown in FIG. 1*b,* is formed by one or more tubular joint bodies best shown in FIGS. 2 and 3 which are connected one another to reach the required blast joint length.

Each tubular joint body has a thickness which largely exceeds the normal coupling thickness and can be assembled in different modular lengths (for instance of 120 cm; 240 cm; 360 cm; 480 or 600 cm). Each tubular joint body according to the present invention is provided with at least one longitudinal slot 4 to house control lines or devices 5, such as e.g. flat packs, control lines, optical fibre cables or a combination thereof. In the configuration shown in FIG. 3, each tubular joint body incorporates two longitudinal slots 4 wherein either a "flat pack" 6 or three encapsulated control lines 7 are housed. These longitudinal slots are phased 180 degree on the cross section and shielded by a series of protecting covers 12. Other configurations can have from one to four longitudinal slots phased evenly on the cross section.

The protecting cover 12 is mounted on the tubular joint body 3 by means of pins 14 and retained in position by means of suitable screws 13. During cover handling these screws are prevented from loosening by PTFE (poly (tetrafluoroethylene)) washers underneath 15.

FIG. 2 illustrates the schematic perspective view of an assembly of three blast joint bodies 3 having an individual length of 120 cm of 3½" size.

Both longitudinal slots are shielded perfectly by protecting covers. The protecting covers positioned in the assembly end positions are bevelled as at 16 in order to facilitate the smooth advancing of the assembly in the well bore. Moreover, each protecting cover is provided with a recess at the bottom end and an overlap at the top end at each joining point to protect the control lines laid in the longitudinal slot of the blast joint itself from penetrating flow stream.

The protecting covers are machined in the standard length of 120 cm, therefore they cover completely the longitudinal slots on any single 120 cm joint body and are combined for longer lengths (240 cm, 360 cm, 480 cm, 600 cm). The standard length of the protective cover allows its easy handling during well site assembly.

The materials of the blast joint according to the present invention may be made of any suitable metallurgies exhibiting erosion/corrosion resistant properties. In the preferred embodiment of the present invention, however, the materials are: Super Duplex 25 Cr for the blast joint bodies; 17-4 PH for the protecting cover and pins; C 22 for the cap screws. These metallurgies insure a minimum hardness of 34 HRC and cope with most corrosive environments. For more demanding environments (higher $H_2S$, $CO_2$, high temperature and chlorides) super austenitic SS and/or nickel base alloys can also be used. In case a heavy solid content is expected a special chrome coating can be applied.

In the proposed embodiment, the blast joint of the present invention is provided with two longitudinal slots, phased 180 degrees on the cross section, accepting different configurations of control lines.

According to an extended configuration of the present invention, the blast joints could be provided with four longitudinal slots, phased 90 degrees on the cross section, which can accept twice as much "flat packs" or control lines or a combination of both, including also optical fibre cables.

The constructing elements of an assembled blast joint according to the present invention (tubular joint bodies, slots, protecting covers, pins and cap screws) are interchangeable, allowing thereby a fast assembling procedure in a simple way without any special requirement for specialized personnel. The interchangeability property of each tubular joint body according to the present invention is due to a precision machining thereof, in particular of the longitudinal slots and of the joint threads. Each blast joint body shows at its opposite ends male and female threads, machined on conical surfaces and obtained by timing precisely the starting points of all threads. This allows to precisely align (with optimum make up torque) all the longitudinal slots of the joint bodies forming a complete blast joint assembly.

The connection between joint bodies is of the metal to metal type and warrants a very tough torque resistance and perfect sealing (qualification as per API 5 CT). Moreover, a make up torque range is foreseen for the connection of the male and female threads of two adjacent joint bodies, so that minimum adjustment in the slot alignment can be obtained by varying the connection torque within the range.

The blast joint according to the present invention allows the simultaneous prevention of the producing tubing erosion against highly corrosive and high temperature environments. Moreover, it can incorporate and protect in the longitudinal slots any number or combination of control lines which need to cross perforated levels preserving their integrity and so granting the transmission of hydraulic and/or electric power between remote operated tools placed on opposite sites of a perforation set.

We claim:

1. A blast joint assembly for preserving a production tubing placed in a production zone in an oil or gas well, comprising:

at least one tubular joint body having at least one longitudinal slot on its outer surface and having male and female end threaded connections allowing a precise metal to metal make up between different modular joint bodies of the same assembly;

at least one protecting cover shielding said longitudinal slot, capable of protecting control lines housed in said longitudinal slot(s), and means for retaining the protecting cover on the tubular joint.

2. A blast joint assembly according to claim 1, wherein each tubular joint body has two to four longitudinal slots evenly phased on the cross section.

3. A blast joint assembly according to claim 1, wherein said male and female threads are machined to have identical thread starting points in all joint bodies.

4. A blast joint assembly according to claim 3, wherein a make up torque range is foreseen for the connection of the male and female threads of two adjacent joint bodies, and wherein said torque is kept within said range for a precise alignment of the slots.

5. A blast joint assembly according to claim 1, wherein materials of the blast joint components comprise any suitable metallurgies exhibiting erosion/corrosion resistant properties.

6. A blast joint assembly according to claim 5, wherein the materials comprise a minimum hardness of 34 HRC.

7. A blast joint assembly for preserving a production tubing placed in front of a production zone, comprising:

at least one tubular joint body having at least one longitudinal slot on its outer surface;

at least one protecting cover shielding said longitudinal slot, capable of protecting control lines housed in said longitudinal slot(s), and means for retaining the protecting cover on the tubular joint, wherein said protecting cover is provided with a recess at the bottom end and an overlap at the top end for the protection of said control lines underneath at each cover joining point.

8. A blast joint assembly for preserving a production tubing placed in front of a production zone, comprising:

at least one tubular joint body having at least one longitudinal slot on its outer surface;

at least one protecting cover shielding said longitudinal slot, capable of protecting control lines housed in said longitudinal slot(s), and means for retaining the protecting cover on the tubular joint, wherein said protecting cover when used in end blast joint positions on assembled sequences of tubular joint bodies, has a bevelled outer surface.

9. A blast joint assembly for preserving a production tubing placed in front of a production zone, comprising:

at least one tubular joint body having at least one longitudinal slot on its outer surface and having male and female end threaded connections allowing a precise metal to metal make up between different modular joint bodies of the same assembly;

at least one protecting cover shielding said longitudinal slot, capable of protecting control lines housed in said longitudinal slot(s), and means for retaining the protecting cover on the tubular joint, wherein materials of the blast joint components comprise any suitable metallurgies exhibiting erosion/corrosion resistant properties.

10. A blast joint assembly according to claim 9, wherein the materials comprise a minimum hardness of 34 HRC.

* * * * *